US009131773B2

(12) United States Patent
Tsai

(10) Patent No.: US 9,131,773 B2
(45) Date of Patent: Sep. 15, 2015

(54) COMBINATION DRAWER ASSEMBLY AND METHOD OF ASSEMBLING THE SAME

(71) Applicant: Dongguan Master United Plastic & Hardware Products Co., Ltd, Dongguan, Guandong Province (TW)

(72) Inventor: Tsung-Yu Tsai, Changhua (TW)

(73) Assignee: Dongguan Master United Plastic & Hardware Products Co., Ltd., Dongguan, Guangdong Province (CN)

( * ) Notice: Subject to any disclaimer, the term of this patent is extended or adjusted under 35 U.S.C. 154(b) by 78 days.

(21) Appl. No.: 14/021,209

(22) Filed: Sep. 9, 2013

(65) Prior Publication Data

US 2015/0068996 A1 Mar. 12, 2015

(51) Int. Cl.

| | |
|---|---|
| ***A47B 88/16*** | (2006.01) |
| ***A47B 88/00*** | (2006.01) |
| ***A47B 55/02*** | (2006.01) |

(52) U.S. Cl.

CPC ..... *A47B 88/16* (2013.01); *A47B 55/02* (2013.01); *A47B 88/0085* (2013.01)

(58) Field of Classification Search

CPC .... A47B 55/02; A47B 88/0085; A47B 88/16; A47B 2088/0448; A47B 2210/0032; A47B 2210/07; A47B 87/001

USPC ..... 211/126.15, 133.2, 182, 80; 312/323

See application file for complete search history.

(56) References Cited

U.S. PATENT DOCUMENTS

| | | | | | |
|---|---|---|---|---|---|
| 1,191,198 | A | * | 7/1916 | Kuhn et al. | 126/339 |
| 1,989,275 | A | * | 1/1935 | Hatch | 312/408 |
| 2,466,360 | A | * | 4/1949 | Bitney | 108/137 |
| 2,896,789 | A | * | 7/1959 | Sans et al. | 108/28 |
| 2,982,422 | A | * | 5/1961 | Asproyerakas | 211/134 |
| 3,977,528 | A | * | 8/1976 | Berger | 211/182 |
| 4,004,819 | A | * | 1/1977 | Brongo | 280/79.3 |
| 4,030,425 | A | * | 6/1977 | Yeomans | 108/181 |
| 4,441,771 | A | * | 4/1984 | Roesler | 312/322 |
| 4,725,066 | A | * | 2/1988 | Nootenboom et al. | 280/79.3 |
| 4,795,041 | A | * | 1/1989 | Remmers | 211/126.15 |
| 4,887,538 | A | * | 12/1989 | Arnold | 108/185 |
| 5,407,084 | A | * | 4/1995 | Remmers | 211/183 |
| 5,810,179 | A | * | 9/1998 | Kleiman | 211/88.01 |
| D411,045 | S | * | 6/1999 | Morandi | D34/21 |
| D460,848 | S | * | 7/2002 | Tzeng | D34/21 |
| 6,508,376 | B1 | | 1/2003 | Chiang | |
| D474,870 | S | * | 5/2003 | Post et al. | D34/12 |
| D488,334 | S | * | 4/2004 | Post et al. | D6/509 |
| 6,726,040 | B1 | * | 4/2004 | Chen | 211/187 |
| 6,732,662 | B2 | * | 5/2004 | Welch et al. | 108/109 |
| D516,347 | S | * | 3/2006 | Post et al. | D6/509 |
| 7,270,245 | B2 | | 9/2007 | Cheng et al. | |

(Continued)

FOREIGN PATENT DOCUMENTS

| | | | | | |
|---|---|---|---|---|---|
| EP | 1133939 | A1 | * | 9/2001 | A47B 88/12 |
| WO | WO 9519122 | A1 | * | 7/1995 | A47B 88/04 |

*Primary Examiner* — Stanton L Krycinski

(74) *Attorney, Agent, or Firm* — Muncy, Geissler, Olds & Lowe, P.C.

(57) ABSTRACT

A combination drawer assembly includes a combination drawer holder and one or a number of basket drawers. The combination drawer holder includes a bottom frame, and two support frames connected to the bottom frame in parallel. The support frames provide horizontally aligned seat tracks. Each basket drawer is slidably mounted in two horizontally aligned seat tracks, and prohibited by the respective seat tracks from falling out of the combination drawer holder.

7 Claims, 10 Drawing Sheets

(56) References Cited

U.S. PATENT DOCUMENTS

| | | | | |
|---|---|---|---|---|
| D567,553 | S * | 4/2008 | Post et al. | D6/510 |
| 7,963,408 | B2 * | 6/2011 | Glover | 211/126.15 |
| D653,063 | S * | 1/2012 | Post et al. | D6/510 |
| 8,505,933 | B2 * | 8/2013 | Bernard et al. | 280/33.998 |
| D693,606 | S * | 11/2013 | Hertaus | D6/671.1 |
| 8,919,339 | B2 * | 12/2014 | Mazzetti et al. | 126/339 |
| 2004/0089625 | A1 * | 5/2004 | Tsai | 211/126.2 |
| 2007/0158289 | A1 * | 7/2007 | Chen | 211/186 |
| 2013/0063012 | A1 * | 3/2013 | Lu | 312/334.7 |

* cited by examiner

COMBINATION DRAWER ASSEMBLY AND METHOD OF ASSEMBLING THE SAME

BACKGROUND OF THE INVENTION

1. Field of the Invention

The present invention relates to a combination drawer structure, and more particularly to a combination drawer assembly that prohibits basket drawers from being pulled away from the combination drawer holder. The invention relates also to the assembly method of the combination drawer assembly.

2. Description of the Related Art

U.S. Pat. Nos. 7,270,245 and 6,508,376 disclose two different designs of combination drawer systems. In actual practice, combination drawer systems facilitate delivery and save transportation cost. However, according to these two patents, the drawer can easily be pulled away from the drawer holder. Thus, the storage materials or files can fall out of the drawer accidentally, causing trouble.

SUMMARY OF THE INVENTION

The present invention has been accomplished under the circumstances in view. It is the main object of the present invention to provide a combination drawer assembly, which comprises a combination drawer holder and at least one basket drawer. The combination drawer holder comprises a bottom frame and two support frames connected to the bottom frame in parallel. Each support frame comprises a front tube, a rear tube, and at least one seat track connected between the front tube and the rear tube. Each seat track of one support frame is kept in horizontal alignment with one respective seat track of the other support frame. Each seat track comprises a position-limit rod member and a support rod member disposed at different elevations and kept in vertical alignment. The support rod member comprises a downwardly curved recessed portion. Each basket drawer is slidably mounted in the combination drawer holder. Each basket drawer comprises a basket drawer body, two rails and two balls. The rails are respectively connected to two opposite lateral walls of the basket drawer body, and respectively positioned in between the position-limit rod member and support rod member of one respective seat track of each of the two support frames. The two balls are respectively connected to the two rails and disposed at a bottom side relative to the two rails. The two balls are respectively inserted through the downwardly curved recessed portions of the support rod members of the respective seat tracks and disposed at an outer side relative to the two support rod members.

When compared to the prior art design, the basket drawers of the combination drawer assembly are stopped by the position-limit rod members of the respective seat tracks from upward displacement to escape from the respective seat tracks. Further, the arrangement of the two balls of each basket drawer and the support rod members of the respective seat track prevents the basket drawer from being separated from the combination drawer holder. Therefore, the combination drawer assembly of the present invention can prohibit the basket drawers from being moved away from the combination drawer holder.

The invention also provides a method of assembling a combination drawer assembly that comprises a first step of providing a combination drawer holder and at least one basket drawer. The combination drawer holder comprises a bottom frame and two support frames. The bottom frame comprises a front rod member and a rear rod member. The front rod member has two opposite ends thereof respectively bent in one direction through a predetermined angle to form one respective upright end portion. The rear rod member has two opposite ends thereof respectively bent in one direction through a predetermined angle to form one respective upright end portion. Each support frame comprises a front tube, a rear tube, and at least one seat track connected between the front tube and the rear tube. Each seat track comprises a position-limit rod member and a support rod member disposed at different elevations and vertically kept in alignment. The support rod member comprises a downwardly curved recessed portion. The basket drawer comprises a basket drawer body, two rails and two balls. The two rails are connected to two opposite lateral sides of the basket drawer body. The two balls are respectively connected to the rails and disposed at a bottom side relative to the rails. Thereafter, a send step is proceeded to press-fit the front tubes and the rear tubes of the support frames onto the upright end portions of the front rod member and rear rod, member of the bottom frame, keeping each seat track of one support frame in horizontal alignment with one respective seat track of the other support frame. Thereafter, proceed to the final step of enabling the two balls of each basket drawer to pass through the downwardly curved recessed portions of the support rod members of two horizontally aligned seat tracks by means of the resilience between the support frames and the bottom frame so as to let the two rails of each basket drawer be positioned in between the position-limit rod member and support rod member of each of the two horizontally aligned seat tracks.

Other advantages and features of the present invention will be fully understood by reference to the following specification in conjunction with the accompanying drawings, in which like reference signs denote like components of structure.

DETAILED DESCRIPTION OF THE INVENTION

Figure 1:
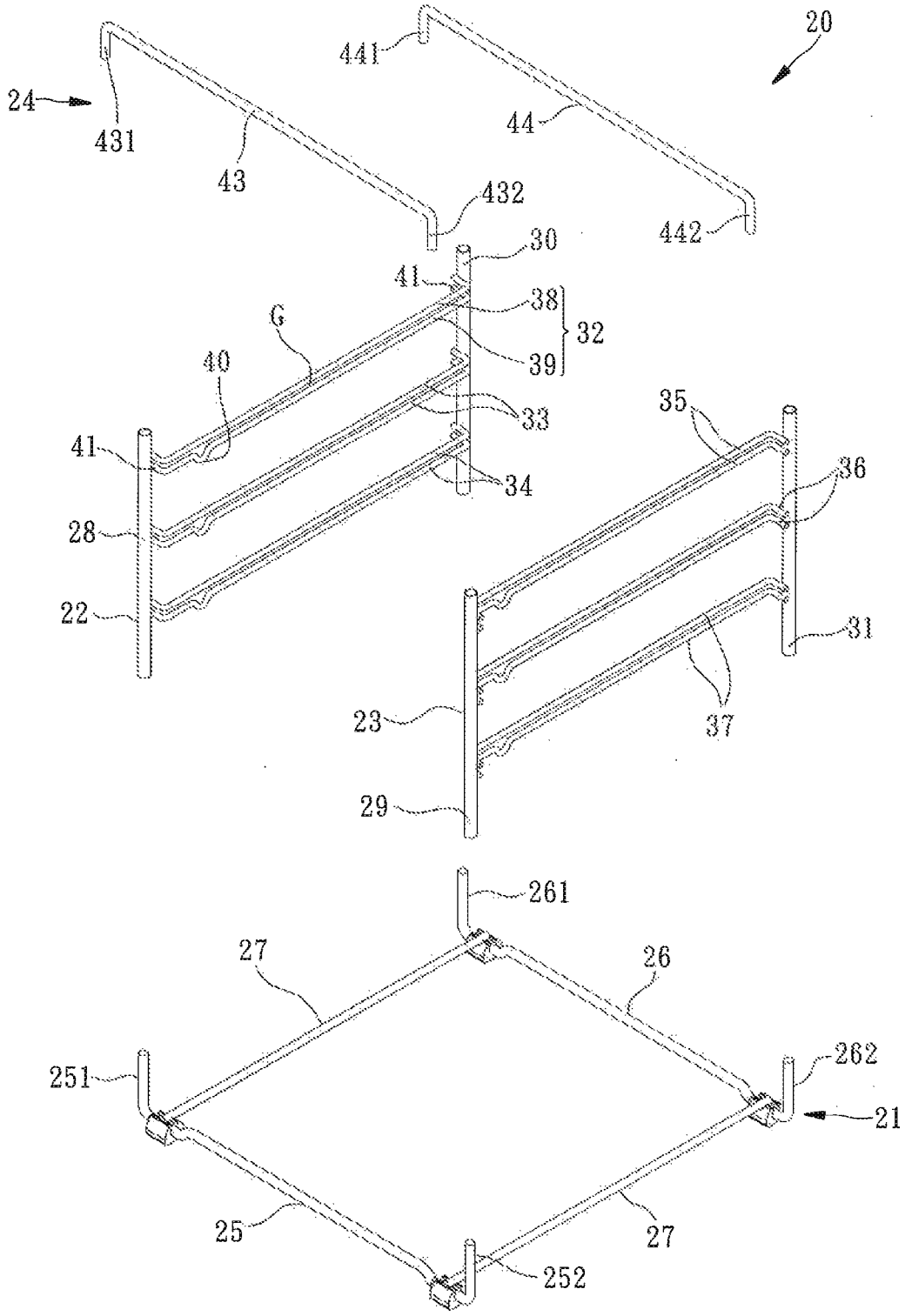
FIG. 1 is an exploded view of a combination drawer holder for combination drawer assembly in accordance with the present invention.

A combination drawer assembly comprises a combination drawer holder and at least one basket drawer. Referring to FIG. 1, the combination drawer holder 20 comprises a bottom frame 21, two support frames 22, 23, and a top frame 24. The bottom frame 21 comprises a front rod member 25, a rear rod member 26, and two connection rod members 27. These rod members are preferably made of metal. In this embodiment, the front rod member 25 has the opposing left and right ends thereof respectively bent upward, forming a respective upright end portion 251, 252. The rear rod member 26 has the opposing left and right ends thereof respectively bent upward, forming a respective upright end portion 261, 262. Each the connection rod members 27 have the respective opposing front and rear ends thereof respectively connected to the front rod member 25 and the rear rod member 26. The two connection rod members 27 are parallel manner. Preferably, the connection rod members 27 are connected to the front rod member 25 and the rear rod member 26 by welding.

The two support frames 22, 23 are identical, each comprising a front tube 28, 29, a rear tube 30, 31, and three seat tracks 32-34, 35-37. The front tube 28, 29 and the rear tube 30, 31 are preferably metal tubes. The front tube 28, 29 and rear tube 30, 31 of the two support frames 22, 23 are respectively and press-fitted onto the upright end portion 251, 252, 261, 262 of the front and rear rod members 25, 26. The three seat tracks 32-34, 35-37 are identical in structure, having the respective opposing front and rear ends thereof respectively fixedly connected to the front tube 28, 29 and the rear tube 30, 31 to hold the front tube 28, 29 and the rear tube 30, 31 in vertical and in a parallel manner. Because the three seat tracks 32-34, 35-37 are identical in structure and respectively connected to the front tube 28, 29 and the rear tube 30, 31 in the same manner, only the seat track 32 is taken as an example for explanation. The seat track 32 comprises a rod member 38, and a support rod member 39 disposed at different elevations and kept in vertical alignment. The position-limit rod member 38 and the support rod member 39 are preferably metal rod members. The position-limit rod member 38 is spaced above the support rod member 39, defining a gap G with the support rod member 39 therebetween.

The support rod member 39 has a middle part thereof curved down and up to form a recessed portion 40, and opposing front and rear ends thereof bent in one direction through a predetermined angle to form a respective connection end portion 41. The two connection end portions 41 of the support rod member 39 are respectively fixedly connected to the front tube 28 and rear tube 30 of the respective support frame 22 by, preferably, welding. In this embodiment, the recessed portion 40 is disposed relatively closer to the front tube 28. However, in actual application, the location of the recessed portion 40 is not limited to the illustration.

The top frame 24 is adapted to connect the two support frames 22, 23. The top frame 24 comprises two top rod members 43, 44. The two top rod members 43, 44 are preferably metal rods. Each top rod member 43, 44 has the opposing left and right ends respectively bent in one direction through a predetermined angle to form a respective perpendicular end portion 431, 432, 441, 442. The two perpendicular end portions 431, 432 of the top rod member 43 are respectively press-fitted into the front tubes 28, 29 of the two support frames 22, 23 opposite to the front rod member 25. The two perpendicular end portions 441, 442 of the top rod member 44 are respectively press-fitted into the rear tube 30, 31 of the two support frames 22, 23 opposite to the rear rod member 26.

Figure 2:
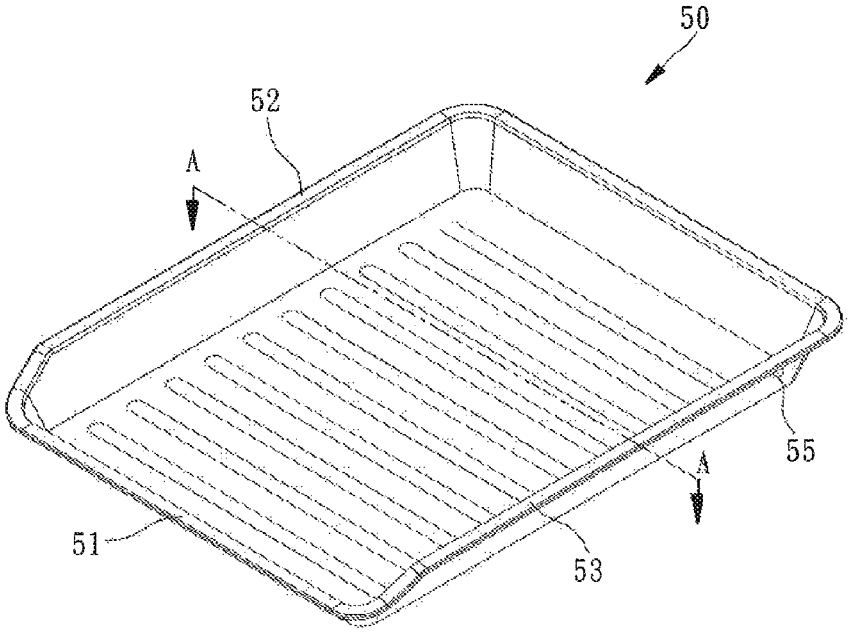
FIG. 2 is an perspective view of a basket drawer for combination drawer assembly in accordance with the present invention.
Figure 3:
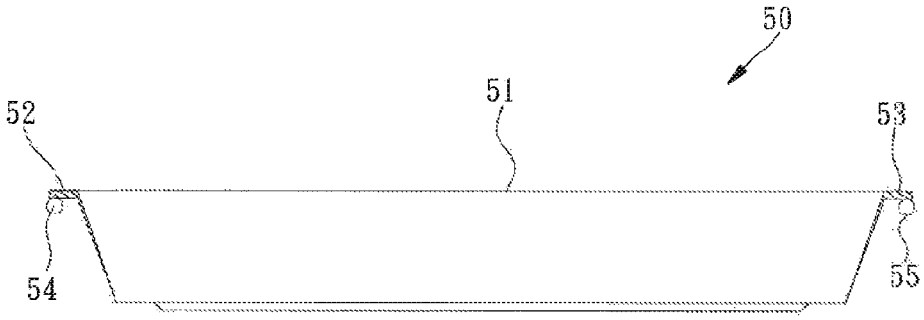
FIG. 3 is a sectional view taken along line A-A of FIG. 2

Referring to FIGS. 2 and 3, each basket drawer 50 comprises a basket drawer body 51, two rails 52, 53, and two balls 54, 55. The inside wall of the basket drawer body 51 defines an accommodation open chamber for accommodating document, stationery, books, magazines, and the like. The two rails 52, 53 are respectively connected to two opposite lateral sides of the basket drawer body 51 and disposed at a top side of the basket drawer body 51. The two balls 54, 55 are respectively connected to the two rails 52, 53 and disposed at a bottom side. In this embodiment, the basket drawer body 51 and the two rails 52, 53 are integrally made in one piece. Preferably, metal, plastic or acrylic is selected for making the basket drawer body 51 and the two rails 52, 53. The two balls 54,55 are respectively connected to the two rails 52, 53 by welding or bonding.

Figure 4:
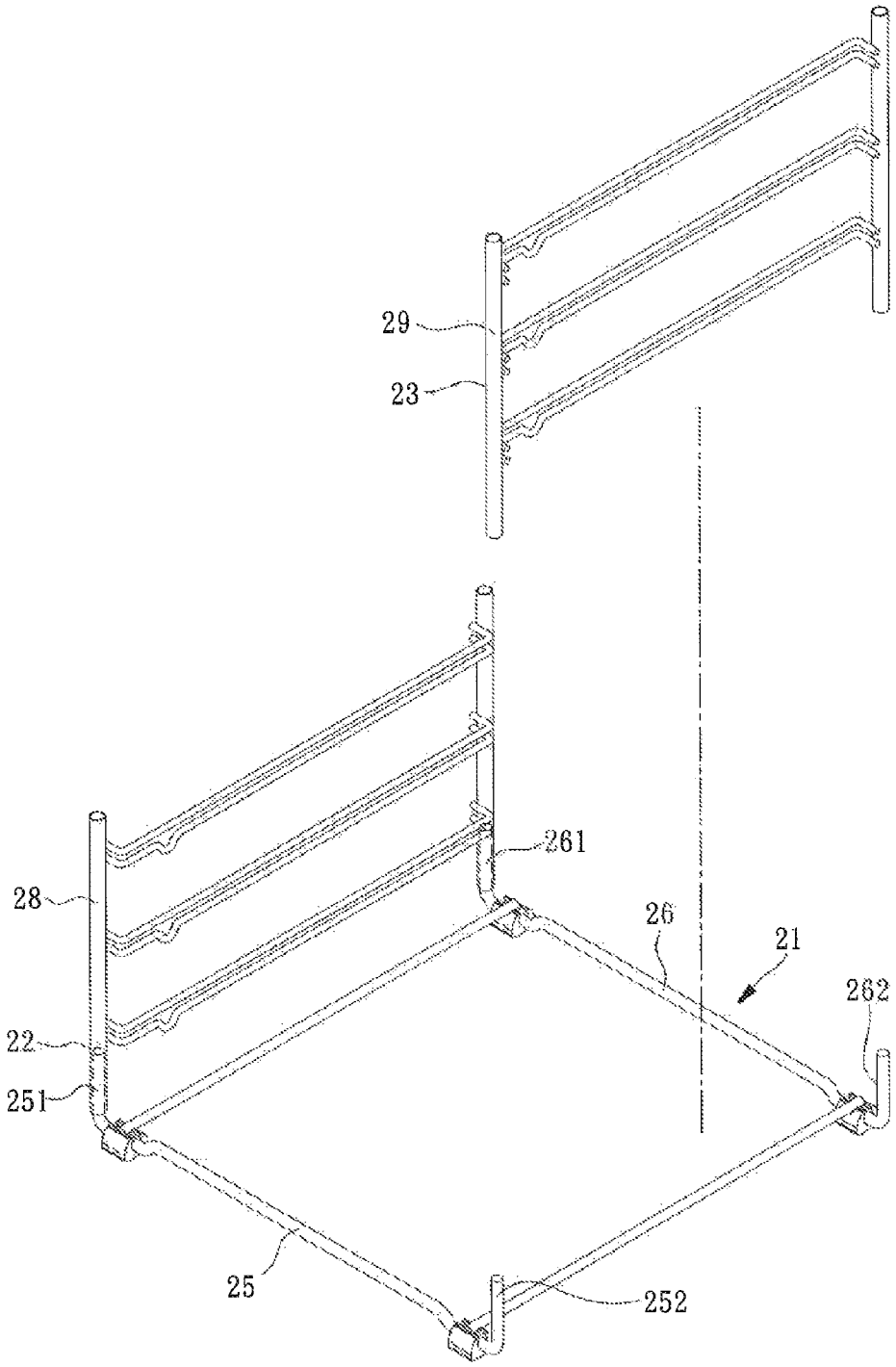
FIG. 4 is a schematic assembly view of the bottom frame and the two support frame shown in FIG. 1.

Referring to FIG. 4, when assembling the combination drawer assembly, attach the two support frames 22, 23 to the bottom frame 21, i.e., press-fit the front tubes 28, 29 and rear tubes 30, 31 of the two support frames 22, 23 onto the upright end portion 251, 252, 261, 262 of the front and rear rod members 25, 26 respectively.

Figure 5:
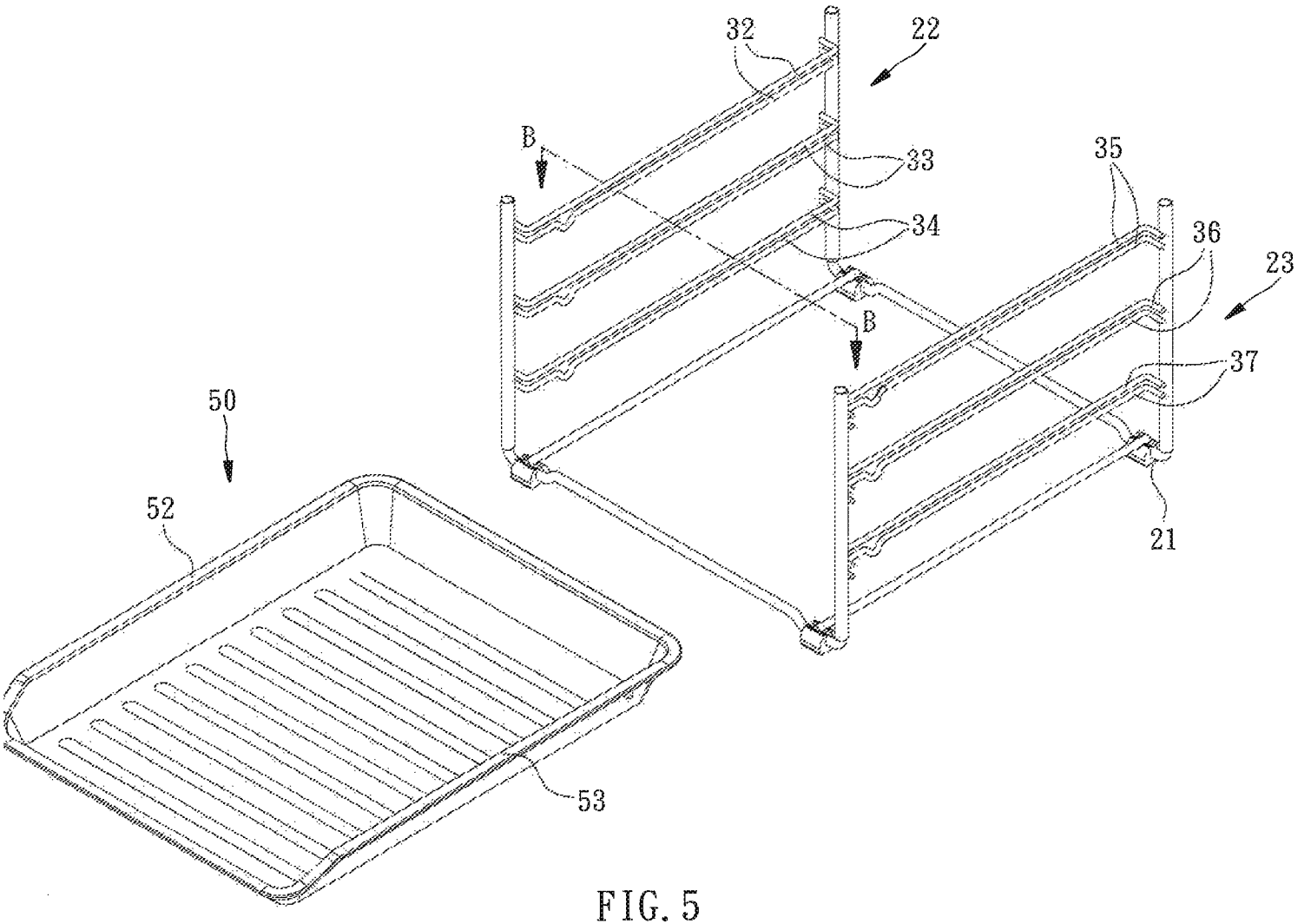
FIGS. 5-8 illustrate the assembly method of the basket drawer shown in FIG. 2.

Referring to FIG. 5, after the two support frames 22, 23 and the bottom frame 21 are well assembled, the three seat tracks 32-34 of one support frame 22 are respectively and horizontally kept in alignment with the respective seat tracks 35-37 of the other support frame 23. In this embodiment, multiple basket drawers 50 having the same width and height are used. The width means the distance between the two rails 52, 53. The height means the depth of the accommodation open chamber defined in each basket drawer 50. The basket drawers 50 can be installed in the support frames 22, 23.

Figure 6:
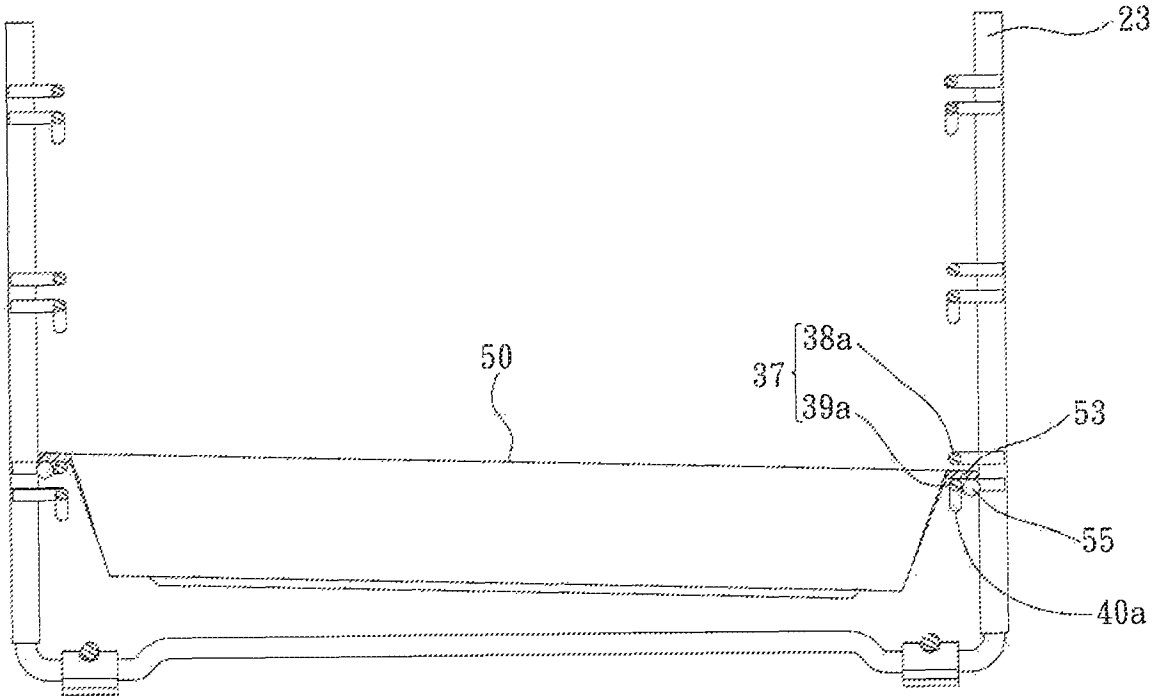
Figure 7:
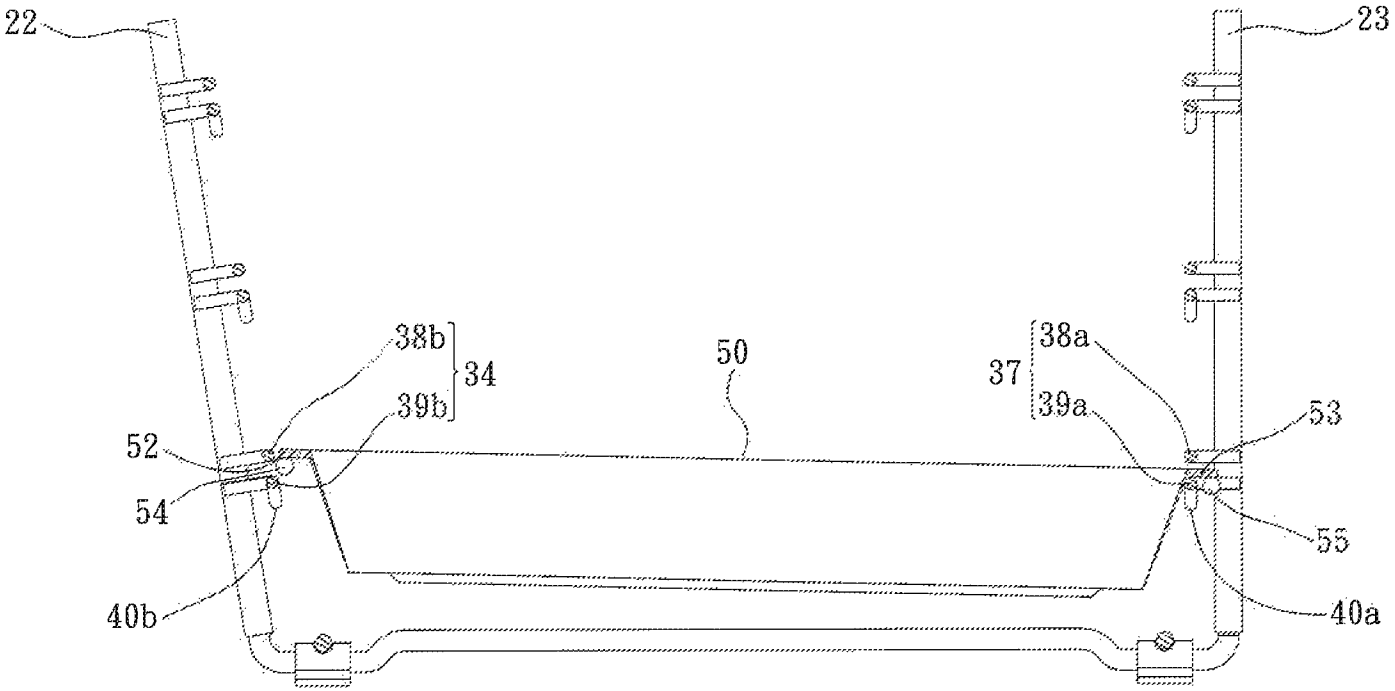
Figure 8:
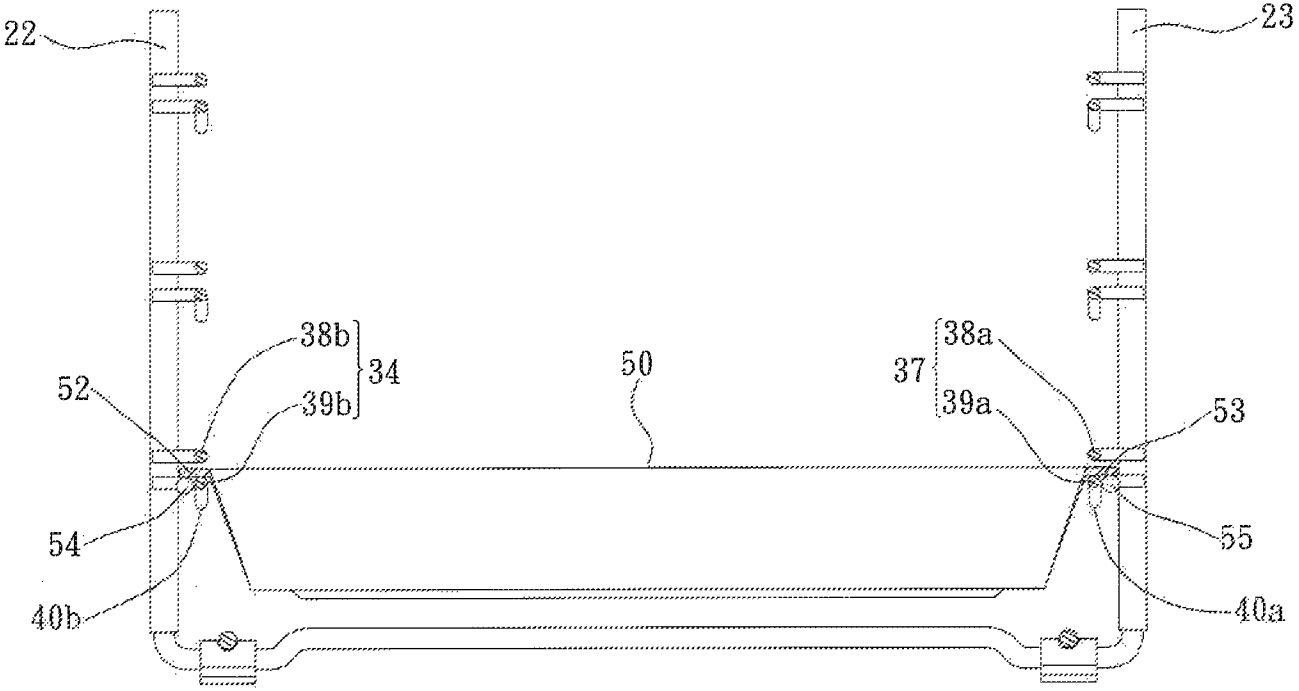

Referring to FIGS. 6-8, the procedure of the installation of one basket drawer 50 in the support frames 22, 23 is shown, wherein the combination drawer holder 20 is illustrated in a sectional view taken along line B-B of FIG. 5. As illustrated in FIG. 6, insert one rail 53 of the basket drawer 50 obliquely in between the position-limit rod member 38*a* and support rod member 39*a* of the seat track 37 of One support frame 23. to force the respective ball 55 through the recessed portion 40*a* of the support rod member 39*a*. Thereafter, as shown in FIG. 7, impart an outward pressure to the upper part of the other support frame 22 to elastically deform the combination drawer holder 20 subject to the resilient material property of the bottom frame 21 and the support frames 22, 23, enabling the other ball 54 of the basket drawer 50 to face toward the recessed portion 40*b* of the support rod member 39*b* of the seat track 34 of the other support frame 22. Finally, as shown in FIG. 8, release the pressure from the other support frame 22 after alignment between other ball 542 of the basket drawer 50 and the recessed portion 40*b* of the support rod member 39*b* of the seat track 34 of the other support frame 22, enabling the other support frame 22 to return to its former position. At this time, the other ball 54 of the basket drawer 50 passes through the recessed portion 40*b* of the support rod member 39*b* of the seat track 34 of the other support frame 22, and thus the basket drawer 50 is accurately installed in the support frames 22, 23, wherein the basket drawer body 51 of the basket drawer 50 is kept in between the two support rod members 39*a*, 39*b*.

Referring to FIG. 8 again, after installation of the basket drawer 50 in the support frames 22, 23, the two rails 52, 53 of the basket drawer 50 are respectively positioned in between the two position-limit rod members 38*a*, 38*b* and the two support rod members 39*a*, 39*b*, and the two balls 54, 55 are respectively disposed at an outer side relative to the support rod members 39*a*, 39*b*. Thus, the position-limit rod members 38*a*, 38*b* prohibit the basket drawer 50 from upward displacement. Because the two balls 54, 55 are respectively stopped at an outer side of the support rod members 39*a*, 39*b*, the basket drawer 50 is prohibited from escaping out of the support frames 22, 23.

Based on what is stated above we know that the basket drawer 50 can be accurately installed in the support frames 22, 23. The other two basket drawers can be installed in the combination drawer holder in the same manner, and therefore the installation of the other two basket drawers will not be described further.

Figure 9:
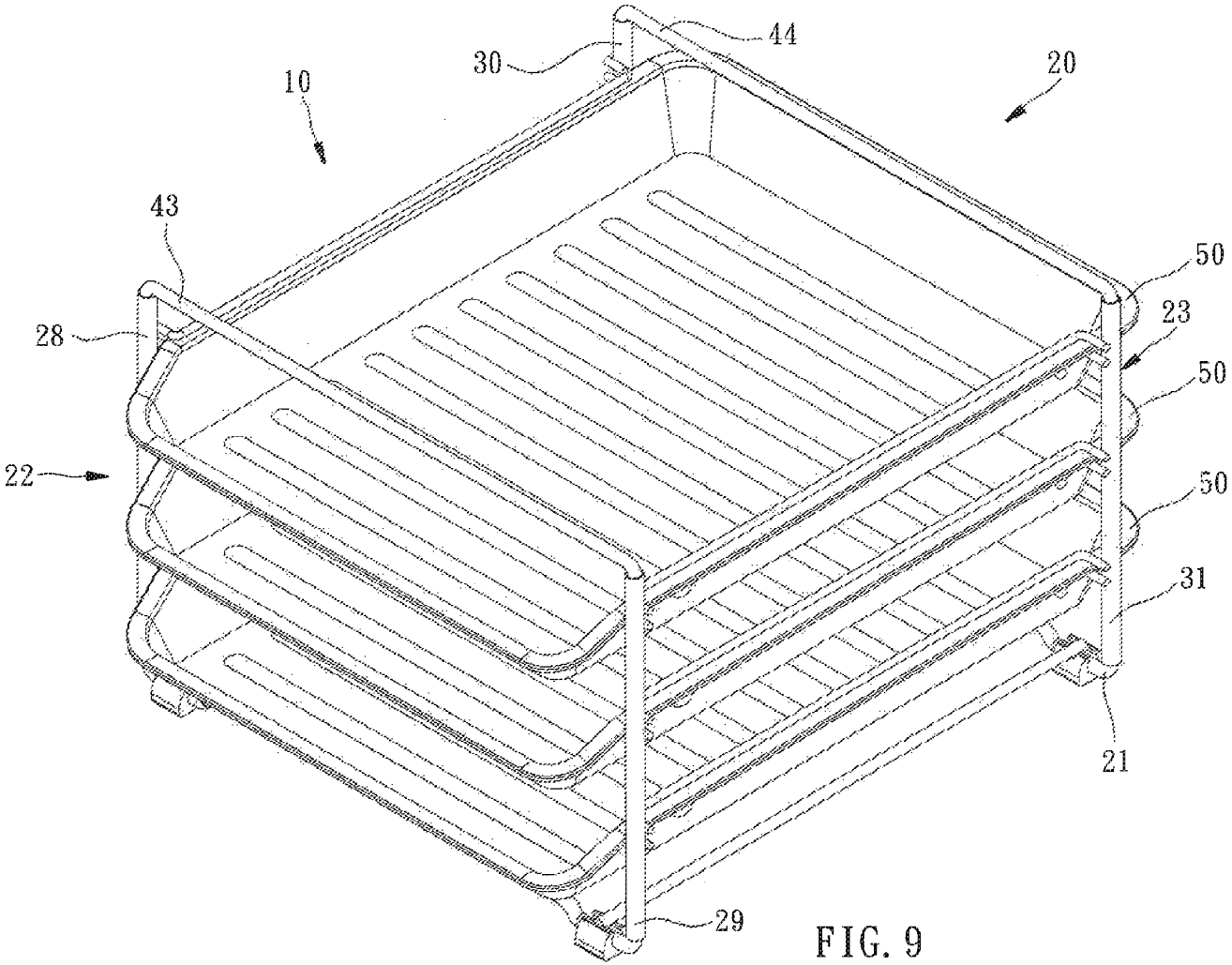
FIG. 9 is an oblique top plan view of the combination drawer assembly.

Referring to FIG. 9, after installation of all basket drawers 50 in the support frames 22, 23, the perpendicular end portions 431, 432, 441, 442 of the top rod members 43, 44 are respectively press-fitted into the front tubes 28, 29 and rear tube 30, 31 of the two support frames 22, 23, enabling the top rod members 43, 44 to be supported on the support frames 22, 23. Thus, the combination drawer assembly 10 is completely assembled. Based on what is stated above we know that the combination drawer assembly 10 can easily be assembled. Further, during delivery, the component parts of the combination drawer holder 20 and the basket drawers 50 can be separately packed, for example, multiple bottom frames 21 and multiple support frames 23 can be packed in one package, and multiple top rod members 43, 44 and multiple basket drawers 50 are separately packed in other packages.

Figure 10:
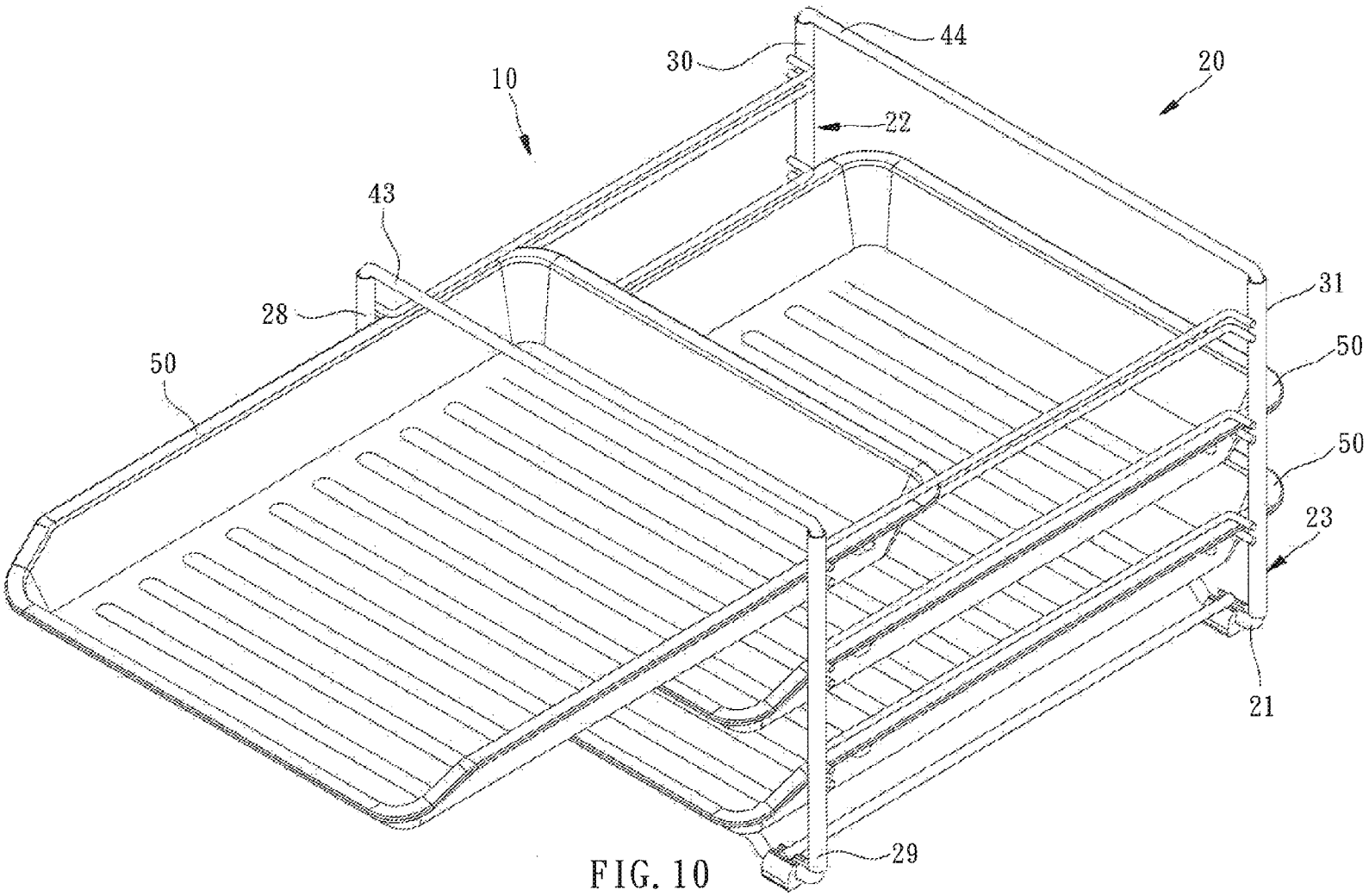
FIG. 10 corresponds to FIG. 9, illustrating a status of use of the combination drawer assembly.

Referring to FIG. 10 and FIG. 9 again, these basket drawers 50 can be pulled forwards relative to the combination drawer holder 20 to an extended position (see FIG. 10) and pushed backwards relative to the combination drawer holder 20 to a retracted position (see FIG. 9). It should be ted that when the basket drawer 50 is pulled to the extended position, the basket drawer 50 does not fall out of the combination drawer hold 20.

Figure 11:
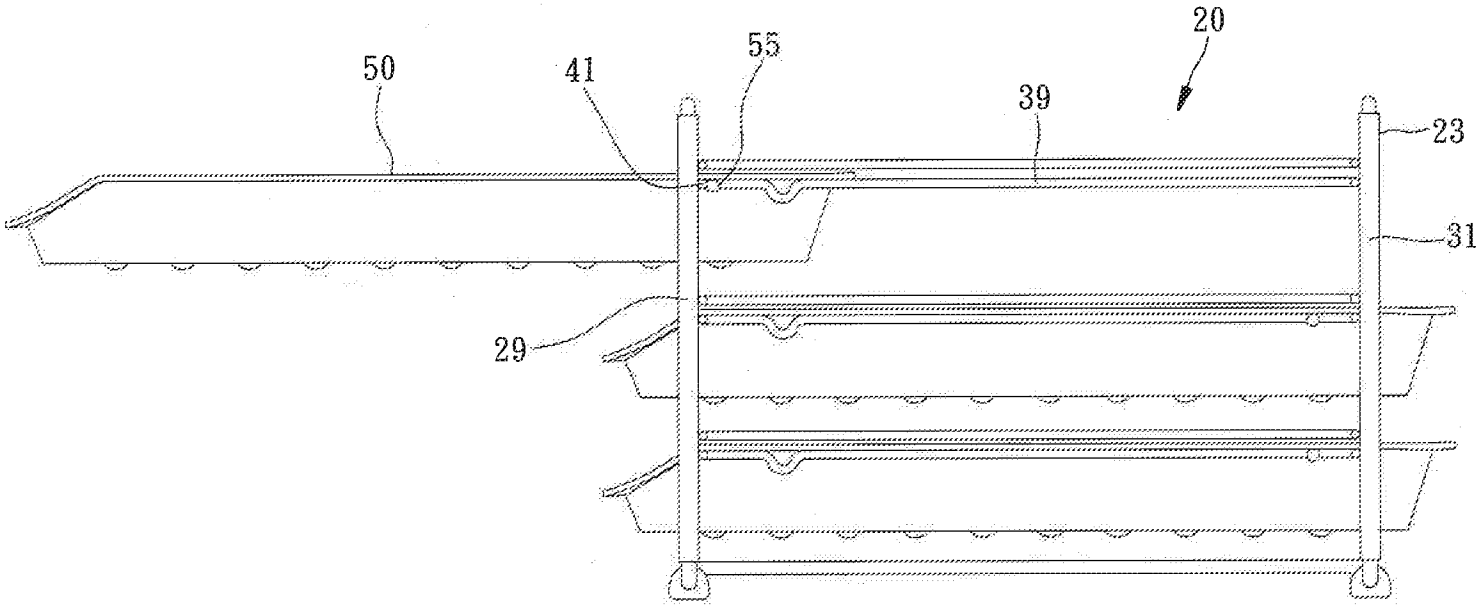
FIG. 11 is a side view of the combination drawer assembly shown in FIG. 10.

Referring to FIG. 11, when the basket drawer 50 is pulled out of the combination drawer holder 20 to the extent, the balls 55 of the basket drawer 50 will be stopped by the connection end portions 41 of the support rod members 39, prohibiting the basket drawer 50 from being directly separated from the combination drawer holder 20. Actually, the front tubes 28, 29 of the two support frames 22, 23 can also stop the balls 50 from forward movement, and therefore the work of stopping the balls 50 is not limited to the connection end portions 41 of the support rod members 39.

It is to be noted that, in the preferred embodiment of the invention described above, the combination drawer holder consists of the said bottom frame, the said support frames and the said top frame, however, in actual practice, the front and rear tubes of the support frames can be the extensions of thee upright end portions of the front and rear rod members of bottom frame, i.e., the front tubes of the support frames are respectively formed integral with the front rod member of the bottom frame and, the rear tubes of the support frames are respectively formed integral with the rear rod member of the bottom frame. Therefore, the structural features of the bottom frame and the support frames are not limited to the above-described preferred embodiment.

Further, in the above-described preferred embodiment of the present invention, the basket drawers have the same width and height, however, in actual application, these basket drawers can be made having different heights. Therefore, the above-described preferred embodiment should not be regarded as limitations of the present invention. Further, in the above-described preferred embodiment of the present invention, the combination drawer assembly is a three-level design, however, this three-level design is not intended to be interpreted a limitation of the present invention. Alternatively, the combination drawer assembly can be a single level or two-level design, or a design more than three levels.

What is claimed is:

1. A combination drawer assembly, comprising:

a combination drawer holder comprising a bottom frame and two support frames bilaterally connected to said bottom frame, said two support frames being parallel, each said support frame comprising a front tube, a rear tube and at least one seat track connected between said front tube and said rear tube, said at least one seat track of one of said support frames being respectively and horizontally aligned with said at least one seat track of the other of said support frames, each said seat track comprising a position-limit rod member and a support rod member disposed at different elevations and being vertically aligned, said support rod member comprising a downwardly curved recessed portion; and at least one basket drawer mounted in and slidable relative to said combination drawer holder, said at least one basket drawer comprising a basket drawer body, two rails and two balls, said two rails being respectively connected to two opposite lateral sides of said basket drawer body, said two rails of said at least one basket drawer being positioned in between a respective said position-limit rod member and support rod member of said seat tracks, said two balls being respectively connected to said two rails and disposed at a bottom side of the respective said rail, wherein each said ball is positioned at an outer side relative to one said support rod member.

2. The combination drawer assembly as claimed in claim 1, wherein said bottom frame comprises a front rod member, a rear rod member and at least one connection rod member, said front rod member having two opposite ends thereof respectively bent to form a respective upright end portion, said two upright end portions of said front rod member being respectively press-fitted into respective bottom ends of said front tubes of said support frames, said rear rod member having opposing two opposite ends thereof respectively bent to form a respective upright end portion, said two upright end portions of said rear rod member being respectively press-fitted into respective bottom ends of said rear tubes of said support frames, each said connection rod member having two opposite ends thereof respectively connected to said front rod member and said rear rod member.

3. The combination drawer assembly as claimed in claim 1, wherein said support rod member of each said seat track has two opposite ends thereof respectively bent to form a respective connection end portion, said two connection end portions of said support rod member of each said seat track being respectively fixedly connected to said front tube and rear tube of one respective said support frame for stopping one respective ball of said at least one basket drawer.

4. The combination drawer assembly as claimed in claim 1, wherein said combination drawer holder further comprises a top frame connected to said support frames at a top side.

5. The combination drawer assembly as claimed in claim 4, wherein said top frame comprises two top rod members, each said top rod member having two opposite ends respectively bent to form a respective perpendicular end portion, said perpendicular end portions of said two top rod members being respectively press-fitted into respective top ends of said front tubes and said rear tubes of said two support frames.

6. The combination drawer assembly as claimed in claim 1, wherein said two rails of said at least one basket drawer are disposed at a top side of said basket drawer body.

7. The combination drawer assembly as claimed in claim 6, wherein said two rails of said at least one basket drawer are formed integral with said basket drawer body in one piece.

* * * * *